US007633497B2

(12) United States Patent
Matsui et al.

(10) Patent No.: US 7,633,497 B2
(45) Date of Patent: Dec. 15, 2009

(54) DRIVE CIRCUIT OF PLASMA DISPLAY DEVICE

(75) Inventors: Tomoya Matsui, Kawasaki (JP); Shigetoshi Tomio, Kawasaki (JP); Akihiro Takagi, Kawasaki (JP); Tetsuya Sakamoto, Kawasaki (JP); Tomokatsu Kishi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 963 days.

(21) Appl. No.: 10/984,978

(22) Filed: Nov. 10, 2004

(65) Prior Publication Data

US 2005/0184928 A1 Aug. 25, 2005

(30) Foreign Application Priority Data

Feb. 20, 2004 (JP) ..... 2004-045166

(51) Int. Cl.
*G09G 5/00* (2006.01)

(52) U.S. Cl. ..... 345/211; 345/212; 345/60; 345/62; 315/169.4

(58) Field of Classification Search ..... 345/211–213, 345/60, 42, 62; 315/169.1–169.4
See application file for complete search history.

(56) References Cited

U.S. PATENT DOCUMENTS 5,786,794 A * 7/1998 Kishi et al. ..... 345/60
6,686,912 B1 * 2/2004 Kishi et al. ..... 345/211
2002/0097003 A1 * 7/2002 Takamori et al. ..... 315/169.4
2002/0097203 A1 * 7/2002 Onozawa et al. ..... 345/67
2002/0097237 A1 * 7/2002 Tomio et al. ..... 345/211
2003/0197696 A1 * 10/2003 Onozawa et al. ..... 345/212
2003/0214244 A1 * 11/2003 Onozawa et al. ..... 315/169.3

FOREIGN PATENT DOCUMENTS

JP 2002-62844 2/2002

OTHER PUBLICATIONS

T. Kishi, et al., A New Driving Technology for PDPs with Cost Effective Sustain Circuit, SID 01 Digest, pp. 1236-1239, in 2001.

* cited by examiner

*Primary Examiner*—Amare Mengistu
*Assistant Examiner*—Hong Zhou
(74) *Attorney, Agent, or Firm*—Staas & Halsey LLP

(57) ABSTRACT

An air purifier includes a main body defining an air passage therein to allow sucked air to pass therethrough prior to being discharged, and a first filter installed in the main body to be switched between a closed state and an open state. The first filter removes contaminants from the sucked air in the closed state, and allows the sucked air to pass through the air passage in the open state. The air purifier may include a main body to suck and discharge air, with a bypass passage formed in the main body so that the bypass passage is opened or closed by a door, and a first filter installed in the main body. The sucked air passes through the first filter prior to being discharged when the door is closed, and passes through the bypass passage prior to being discharged when the door is opened.

3 Claims, 13 Drawing Sheets

DRIVE CIRCUIT OF PLASMA DISPLAY DEVICE

CROSS-REFERENCE TO-RELATED APPLICATIONS

This application is based upon and claims the benefit of priority from the prior Japanese Patent Application No. 2004-045166, filed on Feb. 20, 2004, the entire contents of which are incorporated herein by reference.

BACKGROUND OF THE INVENTION

1. Field of the Invention

The present invention relates to a drive circuit and a method for driving a flat panel display device, and in particular, to these suitable for use in a plasma display device.

2. Description of the Related Art

Conventionally, there are two-electrode type plasma display panels (PDPs) which perform selective discharge (address discharge) and a sustain discharge between two electrodes, and three-electrode type PDPs performing address discharge using the third electrode as plasma display devices such as AC drive type PDPs, which are one of matrix type flat panel display devices. Further, in the three-electrode type, the third electrode can be formed on a substrate on which a first electrode and a second electrode performing the sustain discharge are disposed, or the third electrode can be formed on the other opposing substrate.

Since any of the above-described respective type PDP devices have the same operational principle, a configuration example of the PDP device in which the first and second electrodes performing sustain discharge are provided on the first substrate and at the same time, aside from this, the third electrode is provided on the second substrate opposing the first substrate will be explained hereinafter.

FIG. 12 is a view showing an entire configuration of the AC drive type PDP device.

In FIG. 12, the AC drive type PDP device 1 is provided with scanning electrodes Y1 to Yn parallel to each other and common electrodes X on the first substrate, and at the same time, address electrodes A1 to Am are provided on the second substrate opposing to the first substrate in the direction perpendicular to these electrodes Y1 to Yn, and X. The common electrodes X are provided in correspondence with the respective scanning electrodes Y1 to Yn close to these, and the electrodes are connected to each other at one end in common.

A display panel P of the AC drive type PDP device 1 is provided with a plurality of cells disposed in a two-dimensional matrix of m columns and n rows. Each cell Cij is formed by an intersection point of an scanning electrode Yi and an address electrode Aj, and the common electrode X adjacent in correspondence with the intersection point. This cell Cij corresponds to a pixel of a display image, so that the display panel P can display a two-dimensional image.

A common end of the common electrodes X is connected to an output end of an X-side circuit 2, and the respective scanning electrodes Y1 to Yn are connected to output ends of a Y-side circuit 3. The address electrodes A1 to Am are connected to output ends of an address side circuit 4. The X-side circuit 2 is composed of a circuit to repeat discharging, and the Y-side circuit 3 is composed of a circuit to scan linear sequentially and a circuit to repeat discharge. The address side circuit 4 is composed of a circuit to select rows to be displayed.

The X-side circuit 2, the Y-side circuit 3 and the address side circuit 4 are controlled by control signals supplied from a control circuit 5. In other words, display operation of the PDP device is performed by determining a cell to be lit with a circuit scanning linear sequentially in the Y-side circuit 3 and the address side circuit 4, and repeating discharge with the X-side circuit 2 and the Y-side circuit 3.

The control circuit 5 generates the control signals based on display data D, a clock CLK indicating a timing at which the display data D is read, a flat panel synchronizing signal HS, and a vertical synchronizing signal VS which are supplied from outside, and supplies these control signals to the X-side circuit 2, the Y-side circuit 3, and the address side circuit 4.

FIG. 13A is a view showing a cross sectional configuration of a cell Cij in column i, row j, which is a pixel. In FIG. 13A, the common electrode X and the scanning electrode Yi are formed on a front glass substrate 11. A dielectric layer 12 to insulate from a discharge space 17 is coated over these electrodes and further over it, an MgO (magnesium oxide) protection film 13 is coated.

Meanwhile, the address electrode Aj is formed on a rear glass substrate 14 disposed facing to the front glass substrate 11. A dielectric layer 15 is coated over it and phosphor 18 is coated further over it. Ne+Xe Penning gas or the like is filled in the discharge space 17 between the MgO protection film 13 and the dielectric layer 15.

FIG. 13B is a view for explaining a capacity Cp of the AC drive type PDP device. As shown in FIG. 13B, in respective cells of the AC drive type PDP device, capacity components Ca, Cb and Cc exist in the discharge space 17, between the common electrode X and the scanning electrode Yi, and the front glass substrate 11 respectively, and the capacity Cpcell per one cell is determined according to the total of these capacity components (Cp cell=Ca+Cb+Cc). The total sum of the capacity of all cells is the panel capacity Cp.

FIG. 13C is a view for explaining luminescence of the AC drive type PDP device. As shown in FIG. 13C, the phosphor 18 in red, blue and green is put in order and coated inside a rib 16 in a strip-shape so that the phosphor 18 is excited and emits light by discharging between the common electrode X and the scanning electrode Yi.

As described above, in the AC drive type PDP device, since discharging (sustain discharge) is performed between the common electrode X and the scanning electrode Yi in a cell to emit light, the X-side circuit 2 and the Y-side circuit 3 (hereinafter referred to as "drive circuit" also) serve as circuits to output a high voltage signal to discharge in the cell. Accordingly, respective elements composing the drive circuit are required a high withstand voltage, which results in a factor to push up the manufacturing cost of the AC drive type PDP device. Therefore, a technology to lower the withstand voltage of the respective elements composing the drive circuit to realize reduction of the manufacturing cost is proposed. For instance, a drive circuit to perform discharge between electrodes by applying positive voltage to one electrode and negative voltage to the other electrode to create potential difference between electrodes to cause discharge is proposed (see Patent Document 1, and Non-Patent Document 1).

FIG. 14 is a view showing a configuration of the drive circuit in the AC drive type PDP device disclosed the Patent Document 1.

In FIG. 14, a capacitive load (hereinafter, referred to as "load") 20 is the total sum of capacity of each cell formed between a common electrode X and a scanning electrode Y. In the load 20, the common electrode X and the scanning electrode Y are formed. Here, the scanning electrode Y is an arbitrary scanning electrode among a plurality of scanning electrodes Y1 to Yn.

The Y-side circuit 3 to drive the scanning electrode Y includes a power supply circuit 22 and a drive circuit 21.

The power supply circuit 22 includes a capacitor CY1, three switches SWY1, SWY2 and SWY3. The switches SWY1 and SWY2 are connected in series between a power supply line of a voltage Vs supplied from the power source and a ground (GND), which is a reference potential. One terminal of the capacitor CY1 is connected to an interconnection point between two switches SWY1 and SWY2, and the switch SWY3 is connected between the other terminal of the capacitor CY1 and the ground. Note that a signal line connected to the one terminal of the capacitor CY1 is referred to as a first signal line OUTAY, and a signal line connected to the other terminal is referred to as a second signal line OUTBY.

The drive circuit 21 includes two switches SWY4 and SWY5. The switches SWY4 and SWY5 are connected in series to both ends of the capacitor CY1 of the power supply circuit 22. In other words, the switches SWY4 and SWY5 are connected in series between the first and second signal lines OUTAY, OUTBY. The interconnection point of two switches SWY4 and SWY5 is connected to the scanning electrode Y of the load 20 via an output line OUTCY.

The X-side circuit 2 for driving the common electrode X includes a power supply circuit 24 and a drive circuit 23. The power supply circuit 24 and the drive circuit 23 correspond to the power supply circuit 22 and the drive circuit 21 in the Y-side circuit 3 respectively. Since the configuration thereof is similar to that of the power supply circuit 22 and the drive circuit 21, respectively, explanation will be restrained.

On the Y side of the drive circuit shown in FIG. 14, by turning the switches SWY1, SWY3 and SWY4 on and the switches SWY2 and SWY5 off, an electric charge in accordance with the voltage Vs given by the switches SWY 1 and SWY3 is stored in the capacitor CY1 and the voltage Vs of the first signal line OUTAY is applied to the load 20 via the output line OUTCY.

Further, in a state that the electric charge in accordance with the voltage Vs is stored in the capacitor CY1, by turning the switches SWY2 and SWY5 on, and switches SWY1, SWY3 and SWY4 off, a voltage of the second signal line OUTBY becomes (−Vs) and the voltage (−Vs) is applied to the load 20 via the output line OUTCY.

Thus, a positive voltage Vs and a negative voltage (−Vs) are alternately applied to the scanning electrode Y of the load 20. Similarly, by performing similar switching control to the common electrode X of the load 20, the positive voltage Vs and the negative voltage (−Vs) are alternately applied. At this time, the voltages (±Vs) applied to the scanning electrode Y and the common electrode X are controlled in such a manner that their phases are in an opposite relation to each other. In other words, when a positive voltage Vs is applied to the scanning electrode Y, a negative voltage (−Vs) is applied to the common electrode X, thereby enabling the creation of a potential difference which makes a discharge between the scanning electrode Y and the common electrode X possible.

FIG. 15 is a waveform diagram showing an operation of the AC drive type PDP device shown in FIG. 12. FIG. 15 shows a waveform example of a voltage applied to the common electrode X, the scanning electrode Y and the address electrode for a sub-field among a-plurality of sub-fields constituting one frame. One sub-field is divided into a reset period composed of an entire writing period and entire erasing period, and an address period and a sustain discharge period.

In the reset period, first, the voltage applied to the common electrode X is reduced from the ground potential level, reference potential, to (−Vs). On the other hand, the voltage applied to the scanning electrode Y is gradually increased with time, and a final voltage obtained by combining the writing voltage Vw and the voltage Vs is applied to the scanning electrode Y.

Thus the potential difference between the common electrode X and the scanning electrode Y becomes (2 Vs+Vw), in spite of being still in a display state as before, discharge is performed in all cells of whole display lines, so that a wall electric charge is formed.(entire writing).

Next, after the voltage of the scanning electrode Y is returned to Vs, the voltage to the common electrode X is increased from (−Vs) to Vs, and at the same time an impressed voltage to the scanning electrode Y is reduced to (−Vs). Thereby, a discharge is started because the voltage of the wall electric charge itself exceeds the discharge start voltage over all cells, so that the stored wall electric charge is erased (entire erasing).

Next, during the address period, in order to perform ON/OFF of the respective cells according to display data, the address discharge is performed linear sequentially. At this time, the voltage Vs is applied to the common electrode X. When a voltage is applied to the scanning electrode Y corresponding to a certain display line, a scan pulse at (−Vs) level is applied to the scanning electrode Y selected linear sequentially, and the voltage at a ground potential level is applied to a not-selected scanning electrode Y.

At this time, an address pulse at a voltage Va is selectively applied to an address electrode Aj corresponding to a cell causing the sustain discharge, that is a cell to be lit, among respective address electrodes Al to Am. As a result, discharge is taken place between the address electrode Aj of the cell to be lit and the scanning electrode Y selected linear sequentially, and a certain amount of the wall electric charge required for next sustain discharge is stored on an MgO protection film surface over the common electrode X and the scanning electrode Y, using the above discharge as a priming (pilot flame).

It should be noted that though FIG. 15 shows an example in which the address period is divided into a first half address period (for instance, sequential scan pulses are applied to the scanning electrodes Y in odd-numbered lines) and the second half address period (for instance, sequential scan pulses are applied to the scanning electrodes Y in even-numbered lines), it is also acceptable to apply the sequential scan pulse to the scanning electrode Y without dividing the address period.

Thereafter, during the sustain discharge period, sustain discharge is performed by alternately applying voltages (+Vs and −Vs) different in polarity from each other to the common electrodes X and the scanning electrodes Y of respective display lines by the drive circuit shown in FIG. 14, and an image of one sub-field is displayed. Incidentally, an operation of alternately applying voltages different in polarity from each other is called a sustain operation, and a pulse at the voltages (+Vs and −Vs) during the sustain operation is called a sustain pulse.

Note that the voltage (Vs+Vx) is applied only when a high voltage is applied first to the scanning electrode Y during the sustain discharge period. This voltage Vx is that to be added for generating a voltage necessary to the sustain discharge by adding to the voltage of the wall electric charge generated during the address period.

(Patent Document 1)

Japanese Patent Application Laid-open No. 2002-62844

(non-Patent Document 1)

"A new Driving Technology for PDPs with Cost Effective Sustain Circuit", SID 01 DIGEST, pp. 1236 to pp. 1239, in 2001, Kishi et al.

Here, in the drive circuit shown in FIG. 14, only three electric potentials, ie. Vs, ground potential level and (−Vs) can be applied to the load 20. However, when the AC drive type PDP device 1 shown in FIG. 12 is operated, the use of a potential larger in potential difference than the potential Vs and (−Vs) is sometimes required for the ground potential level which is a reference potential.

For instance, when address discharge is performed during the address period, the larger the potential difference between the voltage (−Vs) of the scan pulse and the voltage Va of the address pulse, the more the voltage margin related to the scan pulse is increased, so that a stable address discharge can be performed. However, since the range capable of increasing the voltage Va of the address pulse is limited, it is required to set the voltage of the scan pulse lower, in order to make the potential difference between the voltage of the scan pulse and that of the address pulse large.

As a method of lowering the voltage of the scan pulse, as shown in FIG. 16, a drive circuit is conceivable, which is configured to directly apply a voltage (−Vy') lower than the voltage (−Vs) to the load 20. Incidentally, in FIG. 16, only the Y-side circuit is shown and the same symbols and numerals are attached to the components having the same functions as those of the components shown in FIG. 14.

In FIG. 16, a numeral 25 designates a negative potential supply circuit. The negative potential supply circuit 25 includes a switch SWY11 connected between a power supply line of the voltage (−Vy') supplied from the power source and the output line OUTCY. By configuring like this and controlling the switch SWY11, it becomes possible to apply the voltage (−Vy') which is lower than (−Vs) to the load 20.

However, in the drive circuit shown in FIG. 16, there is a problem in that a negative potential must be supplied to every output end (output line OUTCY) for the load 20. Furthermore, since a voltage of (Vs+Vy') is exerted on the switch SWY4 in the drive circuit 21 and the switch SWY11 in the negative potential supply circuit 25, material for the switches SWY4 and SWY11 must be high in withstand voltage leading to increased manufacturing costs.

SUMMARY OF THE INVENTION

It is an object of the present invention to make it possible to apply voltage having a potential difference larger than was previously possible in relation to a reference potential to a capacitive load without making a withstand voltage required for respective components composing the drive circuit high.

The drive circuit of the present invention includes:an output line connected to one end of the capacitive load; a first signal line for supplying a first potential higher in potential than the reference potential to the end of the capacitive load; a second signal line for supplying a second potential lower in potential than the reference potential and a third potential lower in potential than the second potential to the end of the capacitive load; a capacitor connected between the first signal line and the second signal line; and a potential supply circuit connected to the first signal line, and for supplying a fourth potential lower than the reference potential to the first signal line.

According to the above-described configuration, by supplying the fourth potential lower than the reference potential to the first signal line from the potential supply circuit, it becomes possible to make an electric potential in the second signal line connected to the first signal line via the capacitor to be a third potential lower than the second potential without applying voltage larger than the potential difference between the reference potential and the first and second potential to respective elements in the drive circuit.

DETAILED DESCRIPTION OF THE PREFERRED EMBODIMENTS

Hereinafter, embodiments of the present invention will be described with reference to the drawings.

Figure 12:
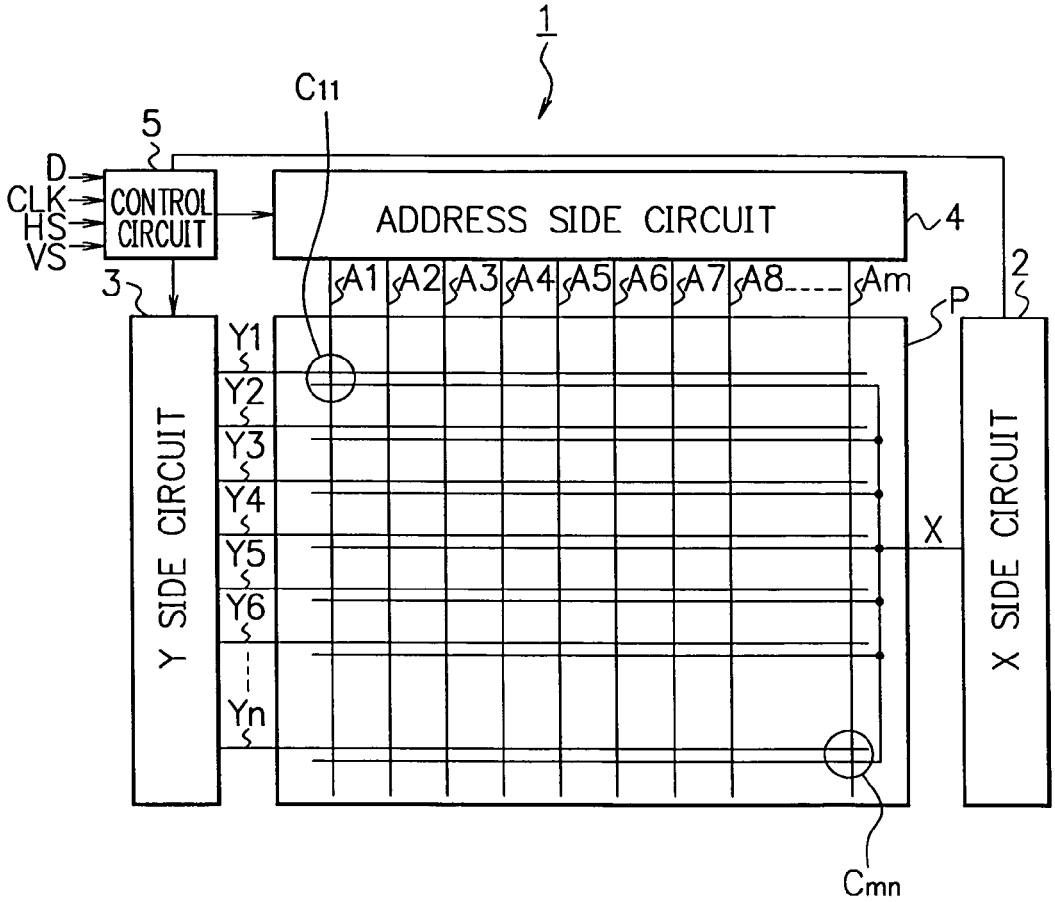
F I G. 12 PRIOR ART
FIG. 12 is a view showing an entire structure of the AC drive type PDP device.
Figure 13A:
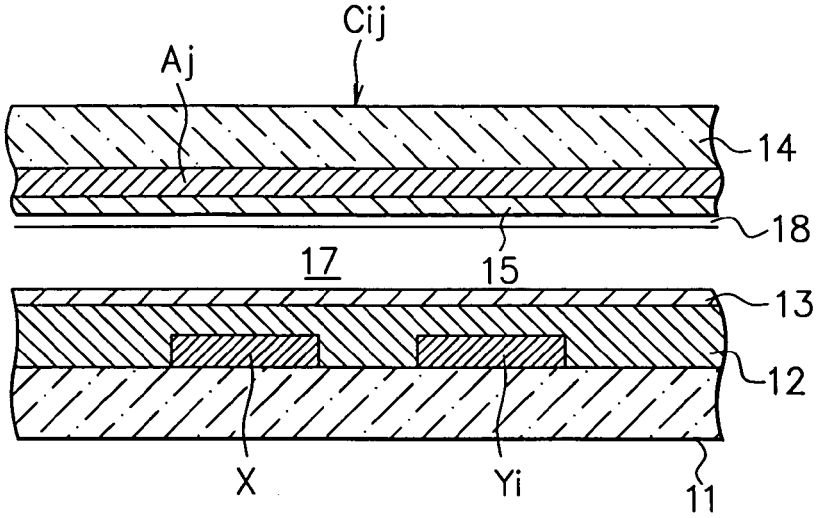
FIG. 13A PRIOR ART
FIGS. 13A, 13B and 13C are views showing a cross sectional configuration of a cell Cij in column i, row j, which is a pixel in the AC drive type PDP device.
Figure 13B:
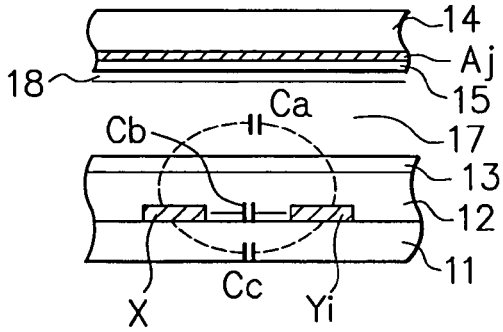
FIG. 13B PRIOR ART
Figure 13C:
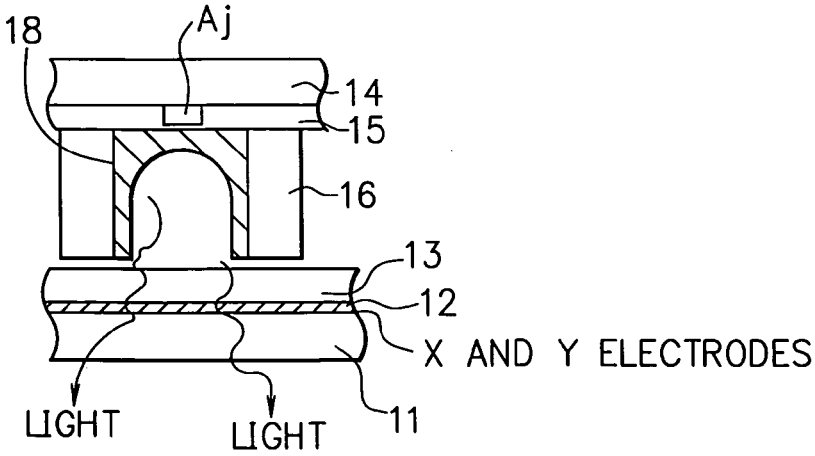
FIG. 13C PRIOR ART
Figure 14:
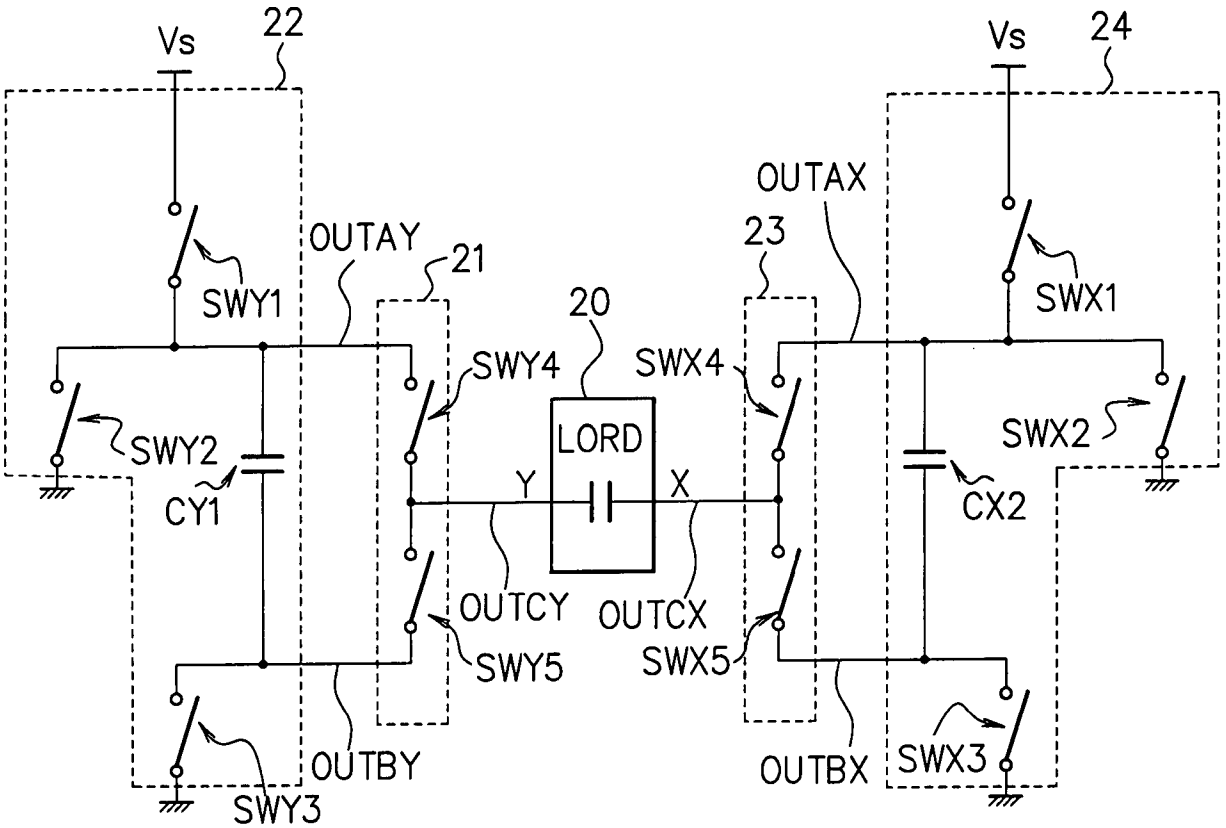
FIG. 14 PRIOR ART
FIG. 14 is a view showing a configuration of the drive circuit in the AC drive type PDP device.
Figure 15:
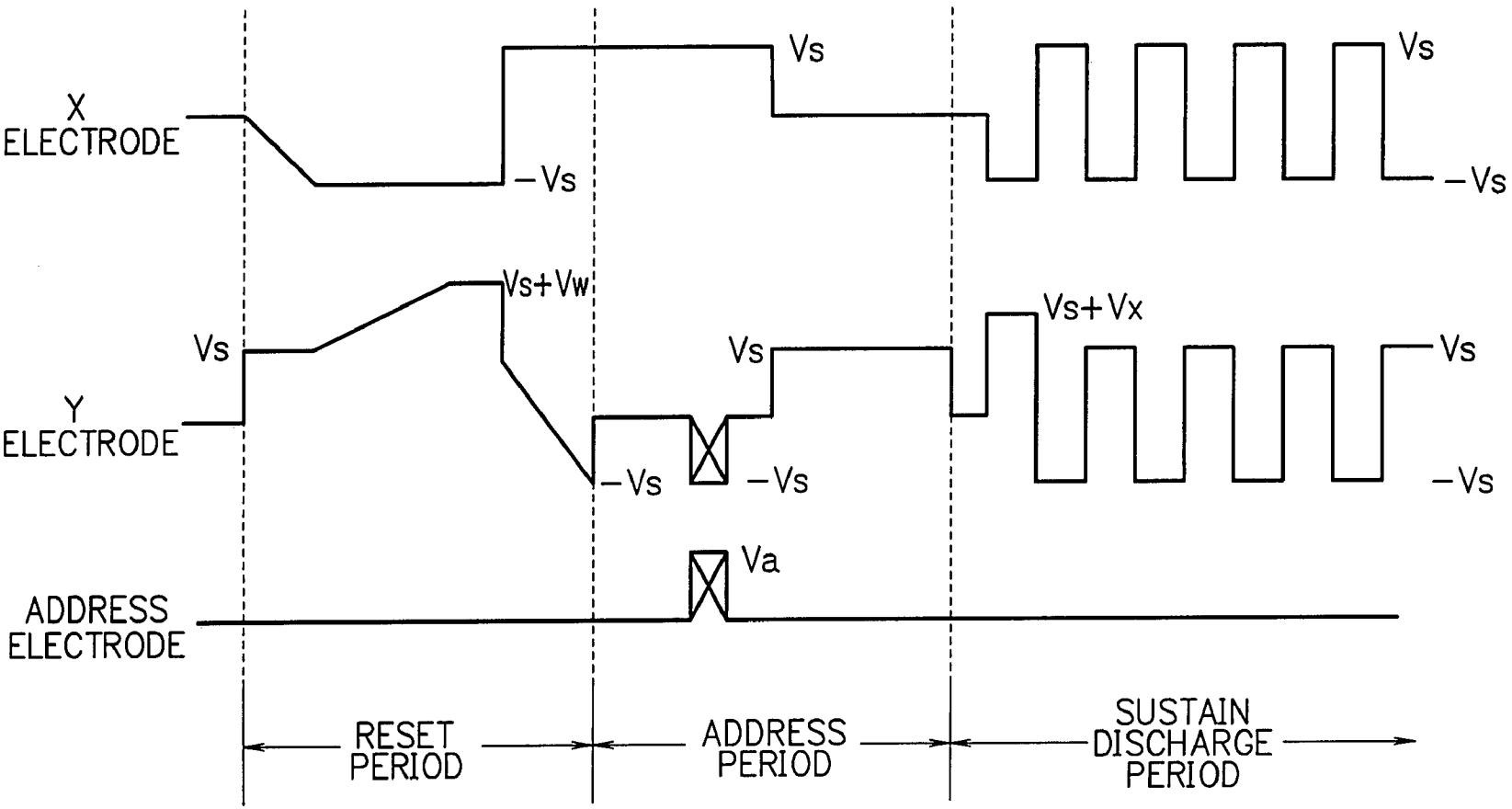
FIG. 15 PRIOR ART
FIG. 15 is a waveform diagram showing the operation of the AC drive type PDP device shown in FIG. 12.
Figure 16:
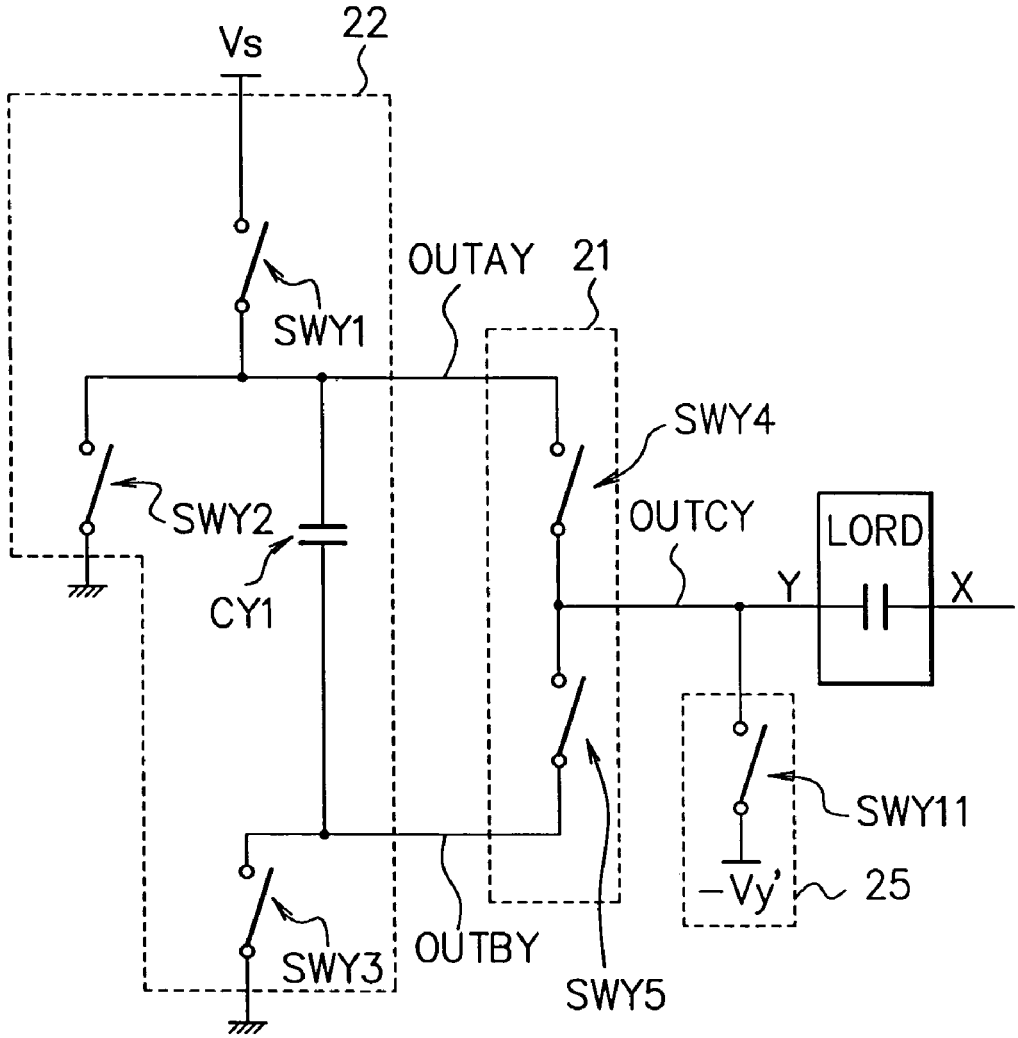
FIG. 16 is a view showing another configuration of the drive circuit in the AC drive type PDP device.

A drive circuit in the embodiments of the present invention can apply a matrix-type flat panel display device using a capacitive load, for instance, an AC drive-type PDP device 1, of which entire configuration is shown in FIG. 12, and of which cell configuration is shown in FIG. 13. In the embodiments explained below, explanation will be made for the case of applying it to the AC drive-type PDP device 1 shown in FIG. 12 and FIG. 13 as an example. In the respective embodiments, only a Y-side circuit 3 will be explained with reference to the drawing, but an X-side circuit 2 can be configured similarly to the Y-side circuit 3, or similarly to a drive circuit shown in FIG. 14.

First Embodiment

Figure 1:
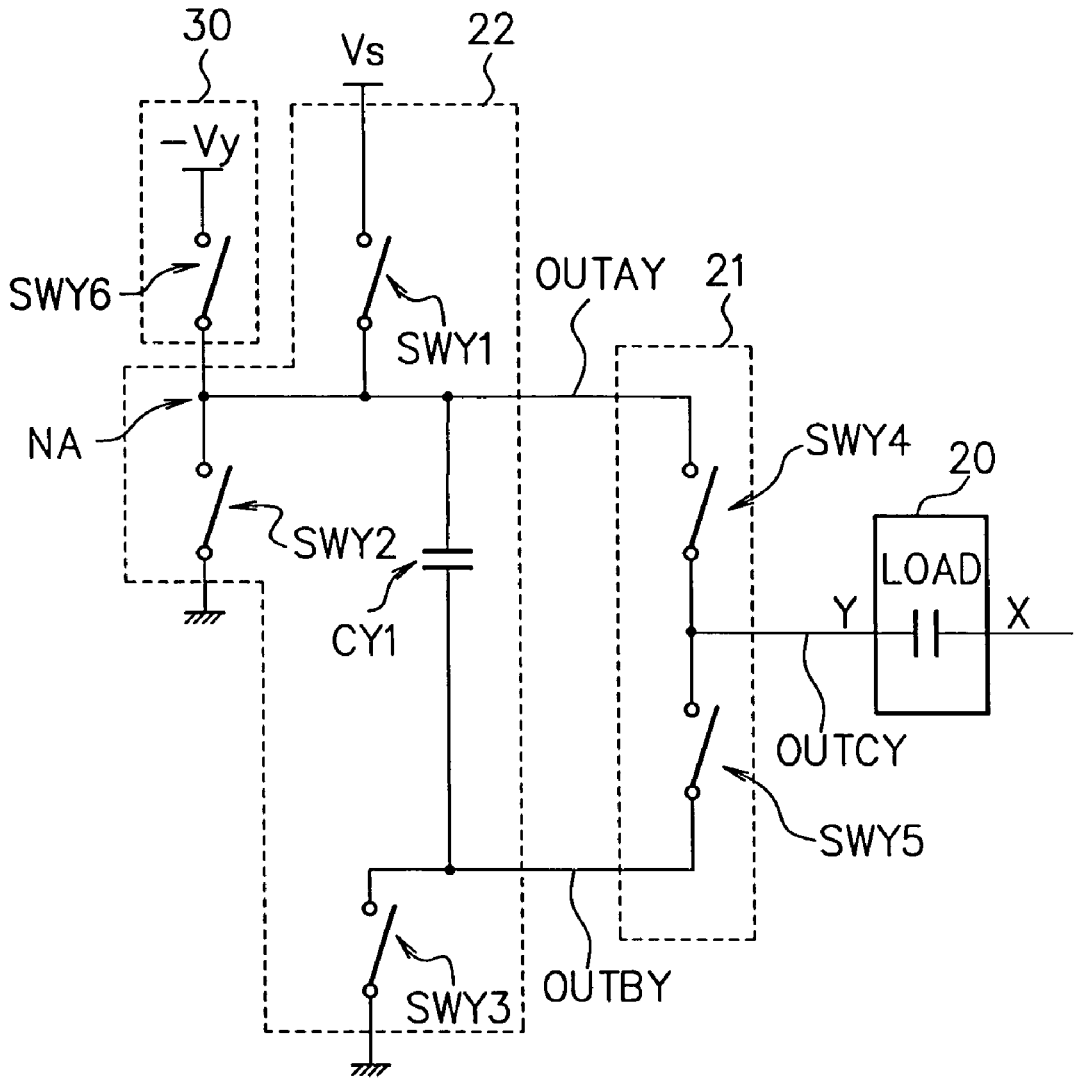
FIG. 1 is a view showing a configuration example of a drive circuit according to a first embodiment.

FIG. 1 is a view showing a configuration example of a drive circuit according to a first embodiment of the present invention.

In FIG. 1, a load 20 is total capacity of a cell formed between a common electrode X and a scanning electrode Y which is an arbitrary scanning electrode among a plurality of scanning electrodes Y1 to Yn. In the load 20, the common electrode X and the scanning electrodes Y are formed.

The Y-side circuit for driving the scanning electrode Y includes a negative potential supply circuit 30, in addition to a power supply circuit 22 and a drive circuit 21.

The power supply circuit 22 includes a capacitor CY1, and three switches SWY1, SWY2, SWY3. The switches SWY1 and SWY2 are connected in series between a first power supply line through which a voltage Vs is supplied from a first power source and a ground (GND) which is a reference potential. One of terminals of the capacitor CY1 is connected to an interconnection point of the two switches SWY1 and SWY2, and the switch SWY3 is connected between the other terminal of the capacitor CY1 and the ground. Note that a signal line connected to one terminal of the capacitor CY1 is taken for a first signal line OUTAY and a signal line connected to the other terminal is taken for a second signal line OUTBY.

Each of three switches SWY1, SWY2 and SWY3 is usually composed of a MOSFET, an IGBT (Insulated Gate Bipolar Transistor) or the like. But the switch SWY3 can also be formed with only a diode connecting a cathode thereof to the ground side.

The drive circuit 21 are provided with two switches SWY4 and SWY5. The switches SWY4 and SWY5 are connected in series to both sides of the capacitor CY1 of the power supply circuit 22, namely, between the first and second signal lines OUTAY and OUTBY. An interconnection point of the two switches SWY4 and SWY5 is connected to the scanning electrode Y of the load 20 via an output line OUTCY.

Here, the drive circuit 21 can be composed of a circuit for conducting a selective operation of the scanning electrode Y for each line by outputting a scan pulse at the time of scanning during an address period for selecting a display cell based on display data D (period to conduct the selective operation of the switches SWY4 and SWY5 in sequence), and the circuit for conducting a sustain discharge operation at the scanning electrodes Y of the total lines by outputting sustain pulses during the sustain discharge period for conducting discharge to make a display cell emit light according to the display data D (period for performing charge and discharge to and from the load 20 repeatedly using the switches SWY4 and SWY5), namely, a line drive circuit. In other words, the drive circuit 21 can be formed by using a scan drive circuit which applies the scan pulse to the scanning electrode Y during the address period and applies the sustain pulse during the sustain discharge period.

The negative potential supply circuit 30 is provided with a switch SWY6. The switch SWY6 is connected between an interconnection point (node NA) of the switches SWY1 and SWY2, and a second power supply line in which a voltage (−Vy) (−Vy≦Vs) is supplied from the second power source. In other words, the switch SWY6 is connected between the second power source line and the first signal line OUTAY.

Next, operation of the drive circuit shown in FIG. 1 will be explained with reference to FIG. 2 to FIG. 4.

Figure 2:
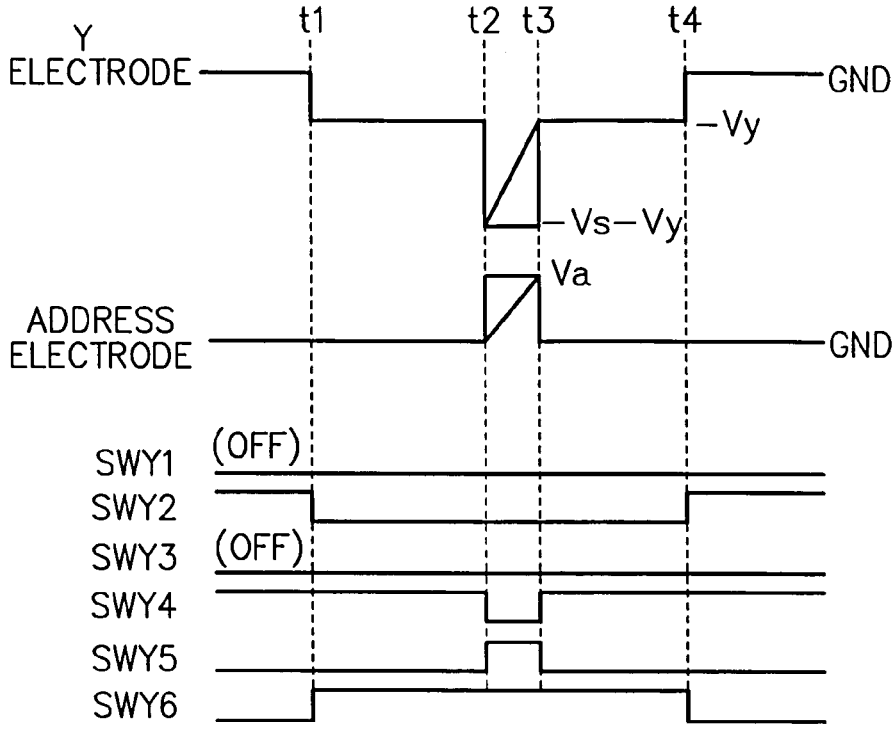
FIG. 2 is a view showing an example of a drive waveform during an address period in the drive circuit shown in FIG. 1.

FIG. 2 is a waveform diagram showing an operation during the address period in a drive circuit shown in FIG. 1.

As shown in FIG. 2, explanation will be made assuming an initial state in which the switches SWY1, SWY3, SWY5, and SWY6 are off, and the switches SWY2 and SWY4 are on, and an electric charge in accordance with the voltage Vs has already been stored in the capacitor CY1. At this time, the voltage of the first signal line OUTAY is at the ground potential level, the voltage of the second signal line OUTBY is (−Vs), and the voltage of the first signal line OUTAY is applied to the load 20 (Y electrode) via the output line OUTCY.

First, at a time t1, the voltage of the first signal line OUTAY is reduced to (−Vy) by turning the switch SWY2 off and the switch SWY6 on, and the voltage is applied to the load 20 via the output line OUTCY. The voltage of the second signal line OUTBY becomes lower than that of the first signal line OUTAY by the voltage Vs in accordance with the electric charge stored in the capacitor CY1, that is, (−Vs−Vy).

Next, at a time t2 when the address pulse at the voltage Va is applied to the address electrode similarly to the conventional manner, the switch SWY4 is turned off, and the switch SWY5 is turned on. Thereby, the voltage (−Vs−Vy) of the second signal line OUTBY is applied to the load 20 via the output line OUTCY. Thereafter, at a time t3, the voltage (−Vy) of the first signal line OUTAY is again applied to the load 20 via the output line OUTCY by turning the switch SWY5 off and the switch SWY4 on.

Next, at a time t4, the voltage of the first signal line OUTAY increases to the ground potential level by turning the switch SWY6 off and the switch SWY2 on. Thereby, the voltage of the second signal line OUTBY becomes (−Vs).

As described above, by controlling the switches SWY1 to SWY6, a scan pulse having lower potential (−Vs−Vy) than the conventional potential (−Vs), that is, the potential difference between the ground potential level and the reference potential is large, can be applied to the load 20 (Y electrode).

Figure 3:
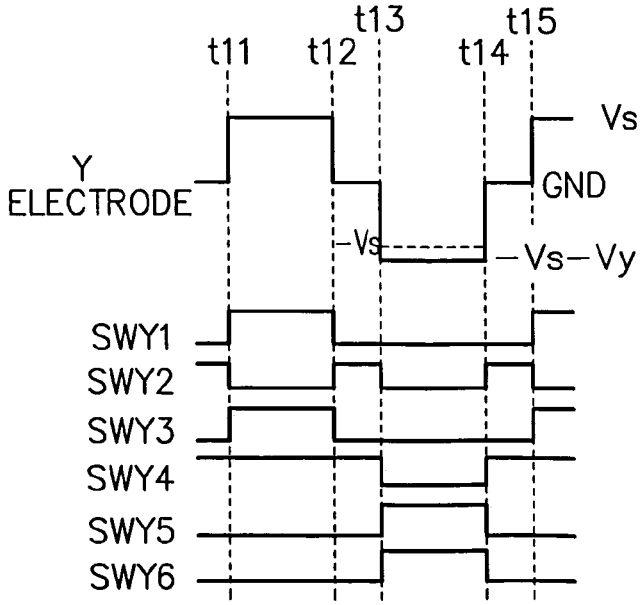
FIG. 3 is a view showing an example of a drive waveform during a sustain discharge period in the drive circuit shown in FIG. 1.

FIG. 3 is a waveform diagram showing an operation of the sustain discharge period by the drive circuit shown in FIG. 1.

As shown in FIG. 3, explanation will be made assuming an initial state in which the switches SWY1, SWY3, SWY5, and SWY6 are off, and the switches SWY2 and SWY4 are on. At this time, the voltage of the first signal line OUTAY is at the ground potential level, the voltage of the second signal line OUTBY is (−Vs), and the voltage of the first signal line OUTAY is applied to the load 20 via the output line OUTCY.

At a time t11, the switch SWY2 is turned off and at the same time the switches SWY1 and SWY3 are turned on. Thereby, the voltage in the first signal line OUTAY increases to Vs and the voltage in the second signal line OUTBY goes to the ground potential level. Further, the voltage Vs in the first signal line OUTAY is applied to the load 20 via the output line OUTCY. At this time, the electric charge corresponding to the voltage Vs which is given by the switches SWY1 and SWY3 is stored in the capacitor CY1.

Next, at a time t12, the voltage in the first signal line OUTAY is reduced to the ground potential level by turning the switches SWY1 and SWY3 off, and the switch SWY2 on, which is applied to the load 20 via the output line OUTCY. Further, the voltage of the second signal line OUTBY becomes lower than that of the first signal line OUTAY by the voltage Vs which corresponds to the electric charge stored in the capacitor CY1, namely, the voltage (−Vs).

Next, at a time t13, the switches SWY2 and SWY4 are turned off, and the switches SWY5 and SWY6 are turned on. Thereby, the voltage (−Vy) of the first signal line OUTAY is reduced further, which leads the voltage of the second signal line OUTBY to (−Vs−Vy). Further, since the switch SWY4 is turned off, and the switch SWY5 is turned on, the voltage (−Vs−Vy) of the second signal line OUTBY is applied to the load 20 via the output line OUTCY.

Thereafter, at a time t14, by turning the switches SWY5 and SWY6 off, and the switches SWY2 and SWY4 on, the voltage of the first signal line OUTAY increases to the ground potential level, and the voltage of the second signal line OUTBY becomes (−Vs). Further, since the switch SWY4 is turned on again, the voltage of the first signal line OUTAY is applied to the load 20 via the output line OUTCY.

Next, at a time t15, the switch SWY2 is turned off and at the same time the switches SWY1 and SWY3 are turned on in a similar manner to that at the time t11.

Hereinafter, operations described above are repeated a predetermined number of times.

As described above, by controlling the switches SWY1 to SWY6, the sustain pulse having a potential (−Vs−Vy) lower than the conventional (−Vs) can be applied to the load 20.

Figure 4:
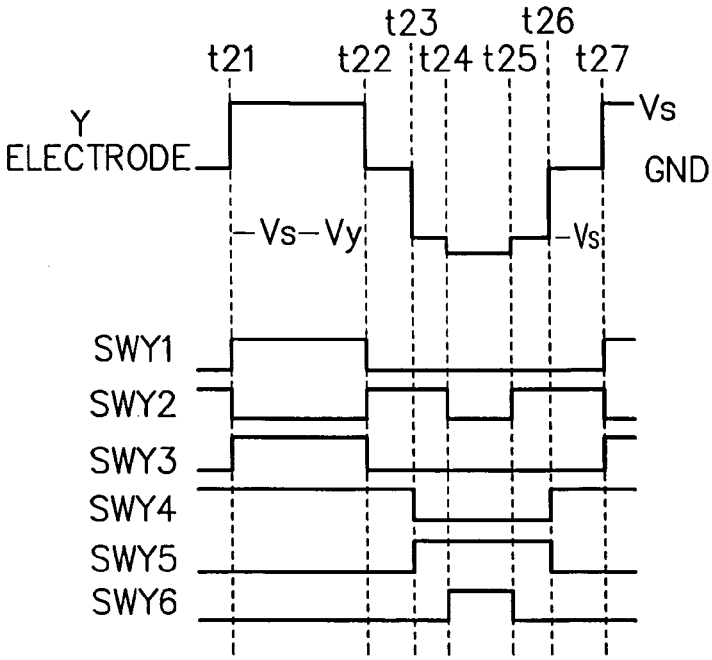
FIG. 4 is a view showing another example of a drive waveform during the sustain discharge period in the drive circuit shown in FIG. 1.

FIG. 4 is a waveform diagram showing another example of the operation during the sustain discharge period in the drive circuit shown in FIG. 1. In the operation during the sustain discharge period showing the waveform diagram thereof in FIG. 3, the voltage applied to the load 20 is directly changed between the ground potential level and the voltage (−Vs−Vy), but the operation during the sustain discharge period shown in FIG. 4 is intended to change once between the ground potential level and the voltage (−Vs−Vy) via the voltage (−Vs).

Since operations by a time t22 are similar to operations by the time t12 shown in FIG. 3, the explanation thereof will be restrained. At a time t23, the switch SWY4 is turned off, and the switch SWY5 is turned on. Thereby, the voltage (−Vs) of the second signal line OUTBY is applied to the load 20 via the output line OUTCY.

Next, at a time t24, by turning the switches SWY2 off, and SWY6 on, the voltage of the first signal line OUTAY is further reduced to (−Vy), which leads a voltage of the second signal line OUTBY to reach (−Vs−Vy). Then, a voltage applied to the load 20 via the output line OUTCY becomes (−Vs−Vy).

Thereafter, at a time t25, by turning the switch SWY6 off, and the switch SWY2 on, the voltage of the first signal line OUTAY increases to the ground potential level, and the voltage of the second signal line OUTBY reaches (−Vs). Accordingly, the voltage applied to the load 20 via the output line OUTCY becomes (−Vs).

Then, at a time t26, the switch SWY5 is turned off and the switch SWY4 is turned on. Through this operation, the voltage of the second signal line OUTBY is applied to the load 20 via the output line OUTCY.

Next, at a time t27, the switch SWY2 is turned off, and the switches SWY1 and SWY3 are turned on.

Hereinafter, operations described above are similarly repeated a predetermined number of times.

As described above, by controlling the switches SWY1 to SWY6, the sustain pulse having a potential of (−Vs−Vy) can be applied to the load 20 similarly to the operation showing the wave diagram thereof in FIG. 3.

As explained above, according to the first embodiment, a negative potential (−Vy) is supplied from the negative potential supply circuit 30 to the first signal line OUTAY in a state that electric charge in accordance with the voltage Vs is stored in the capacitor CY1. Thereby, a voltage of the second signal line OUTBY is made to (−Vs−Vy) lower than (−Vs) so that this voltage can be applied to the load 20 via the output line OUTCY. Further, even when the negative potential (−Vy) is supplied from the negative potential supply circuit 30 to the first signal line OUTAY, the voltages applied to the respective switches SWY1 to SWY6 including the switches SWY4 and SWY6 in the drive circuit are Vs at maximum. Accordingly, the voltage larger than was previously possible can be applied to the load 20 without enhancing the withstand voltage of the respective switches SWY1 to SWY6 in the drive circuit.

Besides, for instance, when a voltage of the scan pulse applied during the address period as shown in FIG. 2 is made to be (−Vs−Vy) which is lower than the conventional value of (−Vs), it becomes possible to make the potential difference between the scan pulse and the address pulse large, in other words, becomes possible to obtain a large selection potential. Then, a voltage margin relating to addressing can be increased to perform a stable address discharge.

Further, for instance, when the voltage of the sustain pulse applied during the sustain discharge period as shown in FIGS. 3 and 4 is made (−Vs−Vy) lower than the conventional (−Vs), it becomes possible to make the potential difference between the scanning electrode Y and the common electrode X due to the sustain pulse is made large so that the brightness per one sustain pulse can be made large, which results in improvement in display quality.

Second Embodiment

Next, a second embodiment of the present invention will be explained.

The second embodiment explained below further includes a coil circuit for realizing an electric power recovery function in the drive circuit according to the first embodiment described above.

Figure 5:
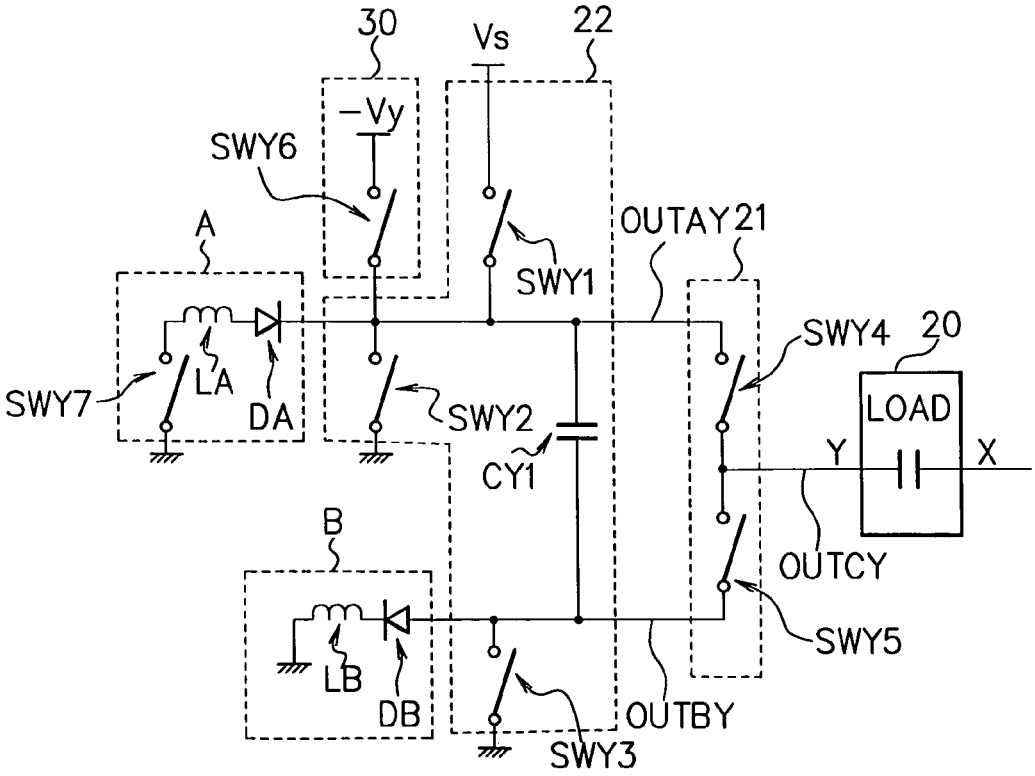
FIG. 5 is a view showing a configuration example of a drive circuit according to a second embodiment.

FIG. 5 is a view showing an example of configuration of the drive circuit according to the second embodiment of the present invention. In FIG. 5, the same symbols and numerals are attached to components having the same functions as the components shown in FIG. 1. Therefore, overlapping explanation thereof will be restrained.

In FIG. 5, a coil circuit A is connected between an interconnection point of two switches SWY1 and SWY2, and a ground, and a coil circuit B is connected between an interconnection point of a switch SWY3 and a capacitor CY1, and the ground. In other words, the coil circuit A is connected between a first signal line OUTAY and the ground, and the coil circuit B is connected between a second signal line OUTBY and the ground.

The coil circuit A includes a diode DA, a coil LA, and a switch SWY7. A cathode terminal of the diode DA is connected to an interconnection point of the switches SWY1 and SWY2, and an anode terminal is connected to the ground via the coil LA and the switch SWY7. The SWY7 is provided to prevent current from flowing in from the coil circuit A when the negative potential (−Vy) is supplied from a negative potential supply circuit 30 to the first signal line OUTAY. The coil circuit B includes a diode DB and a coil LB. The anode terminal of the diode DB is connected to the interconnection point of the switch SWY3 and the capacitor CY1, and the cathode terminal is connected to the ground via the coil LB.

The coils LA and LB are composed to perform an L-C resonance with a load 20 via the switches SWY4 and SWY5. As shown in forward directions of the diodes DA and DB, the coil circuit A is a charge circuit for supplying an electric charge to the load 20 via the switch SWY4, and the coil circuit B is a discharge circuit for releasing an electric charge to the load 20 via the switch SWY5. An electric power recovery function to the load 20 is realized by properly controlling timing of a charge process of the charge circuit composing of the coil circuit A, the switch SWY4, and the load 20, and a discharge process of the discharge circuit composing of the coil circuit B, the switch SWY5 and the load 20.

Incidentally, the coil circuit B shown in FIG. 5 is configured without including a switch, but it is also acceptable to include a switch similarly to the coil circuit A.

Figure 6:
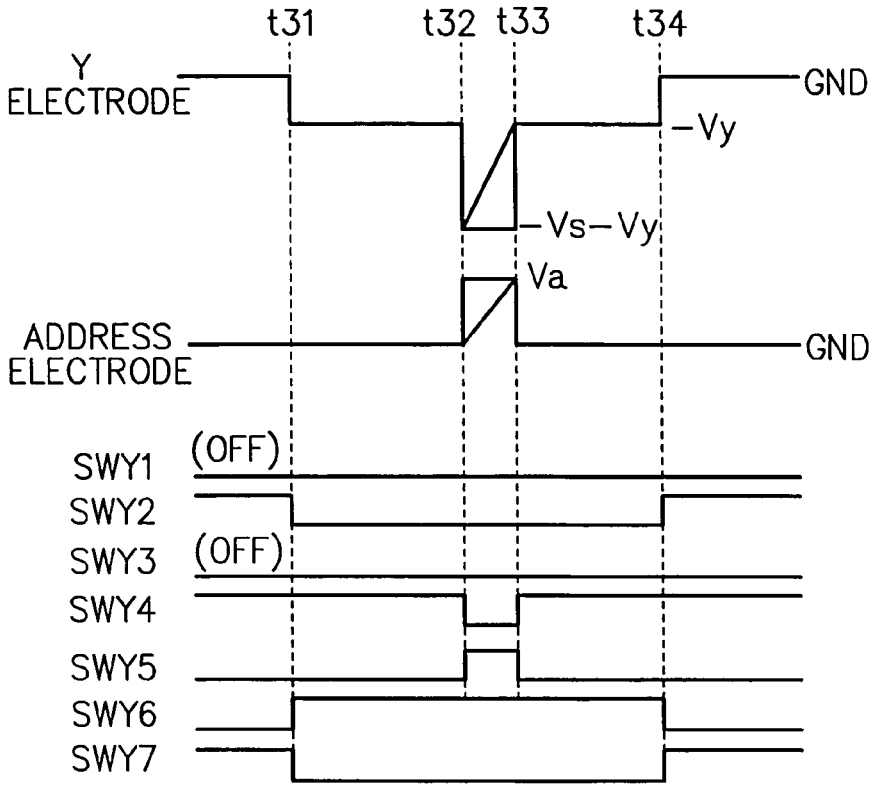
FIG. 6 is a view showing an example of the drive waveform during the address period in the drive circuit shown in FIG. 5.

FIG. 6 is a waveform diagram showing the operation during the address period in the drive circuit shown in FIG. 5.

The operation during the address period represented by the wave diagram in FIG. 6 is different only in that the switch SWY7 in the coil circuit A is turned off while the switch SWY6 is turned on, that is, only while negative potential is supplied to the first signal line OUTAY from the negative potential supply circuit 30 (during the times from t31 to t34 in FIG. 6), and is similar to the operation during the address period of the drive circuit in the first embodiment shown in FIG. 2.

Times t31, t32, t33 and t34 in FIG. 6 correspond to times t1, t2, t3 and t4 in FIG. 2, respectively. Accordingly, in the drive circuit shown in FIG. 5, it is possible to apply the scan pulse of (−Vs−Vy) lower in potential than was previously possible to the load 20 by controlling the switches SWY1 to SWY6 as shown in FIG. 2, and turning the switch SWY7 off during the switch SWY6 is turned on.

Figure 7:
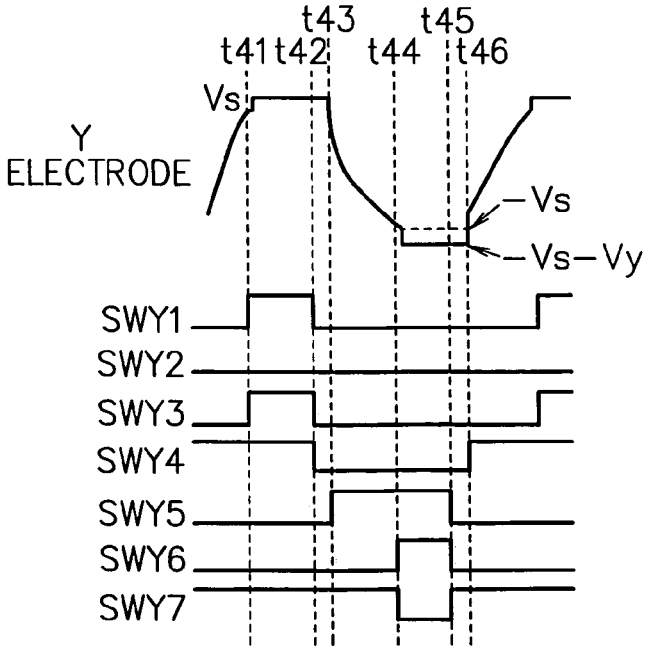
FIG. 7 is a view showing an example of the drive waveform during the sustain discharge period in the drive circuit shown in FIG. 5.

FIG. 7 is a waveform diagram showing an operation during the sustain discharge period by the drive circuit shown in FIG. 5.

As shown in FIG. 7, explanation will be made assuming an initial state in which the switches SWY1, SWY2, SWY3, SWY5 and SWY6 are off, and the switches SWY4 and SWY7 are on. At this time, a voltage of the first signal line OUTAY is increasing gradually owing to the function of the coil circuit A, and the voltage of the first signal OUTAY is applied to the load 20 via the output line OUTCY.

The voltage of the first signal line OUTAY turns the switches SWY1 and SWY3 on to clamp the voltage of the first signal line OUTAY at Vs at a time t41, at which the voltage is near the peak of its rise (before reaching the voltage Vs).

Next, the switches SWY1, SWY3, and SWY4 are turned off at a time t42, and then at a time t43, the switch SWY5 is turned on. Thereby, the second signal line OUTBY and the output line OUTCY are connected electrically. Accordingly, the voltage of the output line OUTCY is gradually decreasing and at the same time, a portion of the electric charge is recovered by the coil circuit B.

At a time t44, at which the voltage is near the lowest point of its descent (i.e., before reaching the voltage (−Vs), the voltage of the second signal line OUTBY is clamped to (−Vs−Vy) by turning the switch SWY7 off, and the switch SWY6 on.

Next, after the switches SWY5 and SWY6 are turned off, and the switch SWY7 is turned on at a time t45, the switch SWY4 is turned on at a time t46. Thereby, the first signal line OUTAY and the output line OUTCY are electrically connected to each other. Accordingly, the voltage of the first signal line OUTAY is increased by the function of the first coil circuit A (releasing of the electric charge, namely, discharging), and as it increases, the voltage of the output line OUTCY is also gradually increased.

Hereinafter, operations described above are similarly repeated a predetermined number of times.

As described above, it is possible to apply the sustain pulse having a potential of (−Vs−Vy) lower than the conventional potential of (−Vs) to the load 20 while realizing the electric power recovery function owing to the coil circuits A and B, by controlling the switches SWY1 to SWY7.

As explained above, according to the second embodiment, it is possible to obtain the similar effect to that obtained by the drive circuit of the first embodiment described previously, and at the same time to realize an electric power recovery function by the coil circuit so that power consumption of the AC drive type PDP device can be reduced.

It should be noted that in the second embodiment described above, the drive circuit in which the coil circuit A for supplying an electric charge to the load 20 as shown in FIG. 5 is connected to the fist signal line OUTAY, and the coil circuit B for discharging the electric charge to the load 20 is connected to the second signal line OUTBY, is explained as an example, but the present invention is not limited to this.

Figure 8:
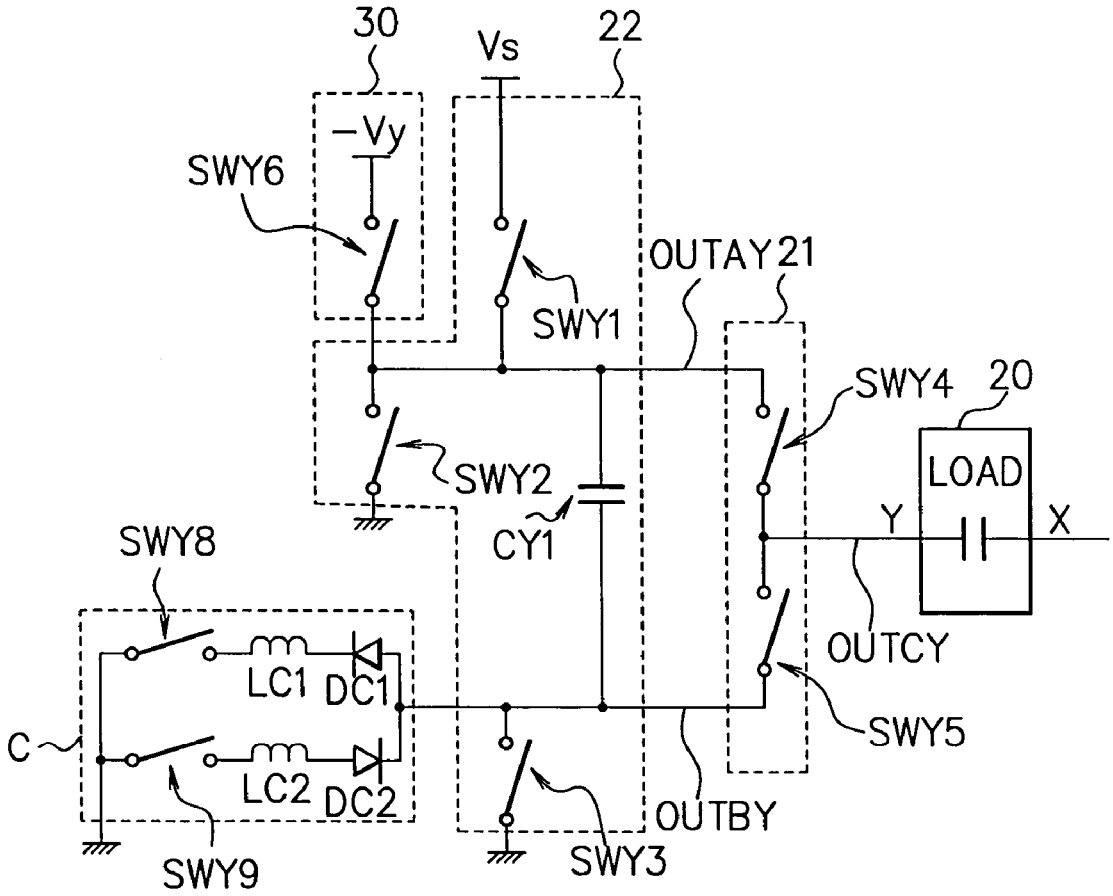
FIG. 8 is a view showing another configuration example of the drive circuit according to the second embodiment.

For instance, as shown in FIG. 8, it is also possible to apply the present embodiment to a drive circuit in which a coil circuit C provided with a function to supply an electric charge to the load 20 and together with a function to discharge the electric charge to the load 20, is connected to the second signal line OUTBY.

FIG. 8 is a view showing another example of configuration of the drive circuit according to the second embodiment. In this FIG. 8, the same symbols and numerals are attached to component and the like having the same functions as the component and the like shown in FIG. 5, so that overlapping explanation thereof will be restrained.

In FIG. 8, the coil circuit C includes diodes DC1 and DC2, coils LC1 and LC2, and switches SWY8 and SWY9. A function to discharge electric charge to the load 20 is realized by the diode DC1, the coil LC1 and the switch SWY8. An anode terminal of the diode DC1 is connected to a second signal line OUTBY, and a cathode terminal of the diode DC1 is connected to the ground via the coil LC1 and the switch SWY8. Similarly, a function to supply electric charge to the load 20 is realized by the diode DC2, the coil LC2 and the switch SWY9. A cathode terminal of the diode DC2 is connected to the second signal line OUTBY and an anode terminal of the diode DC2 is connected to the ground via the coil LC2 and the switch SWY9.

Figure 9:
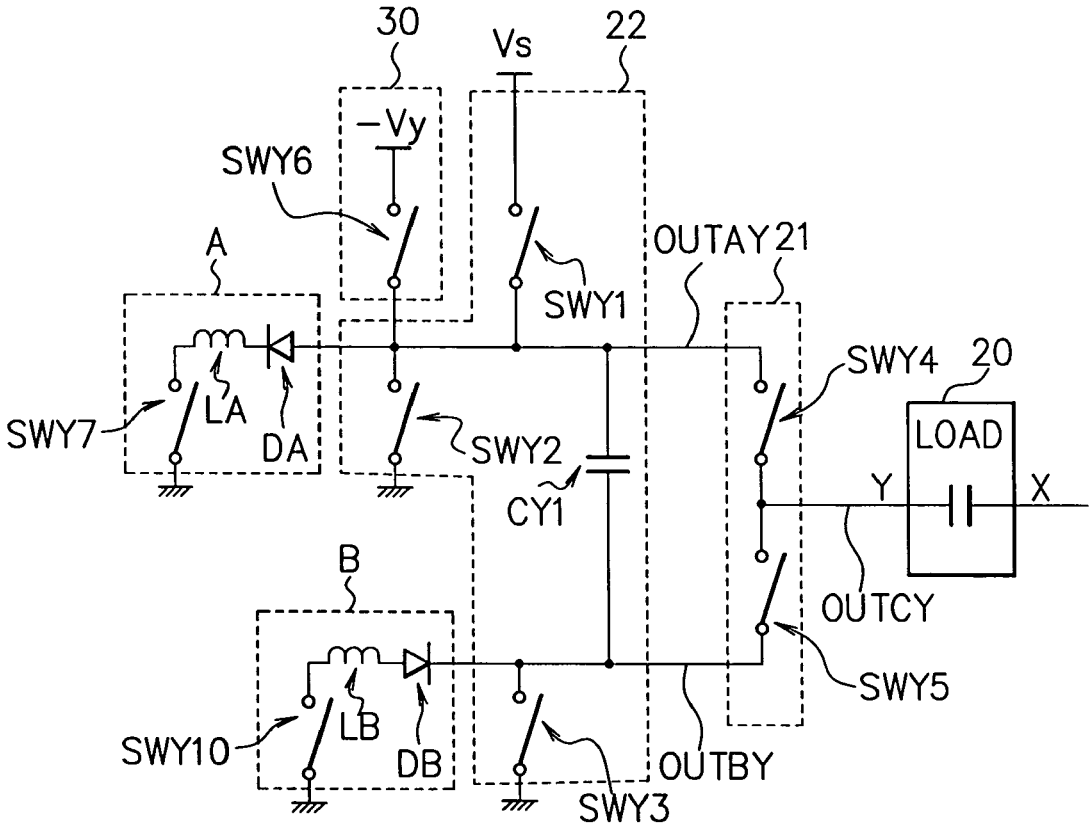
FIG. 9 is a view showing still another configuration example of the drive circuit according to the second embodiment.

Further, for instance, as shown in FIG. 9, it is also possible to apply the present embodiment to a drive circuit in which a coil circuit A for discharging electric charge to a load 20 is connected to a first signal line OUTAY, and a coil circuit B for supplying electric charge to the load 20 is connected to a second signal line OUTBY.

Figure 10:
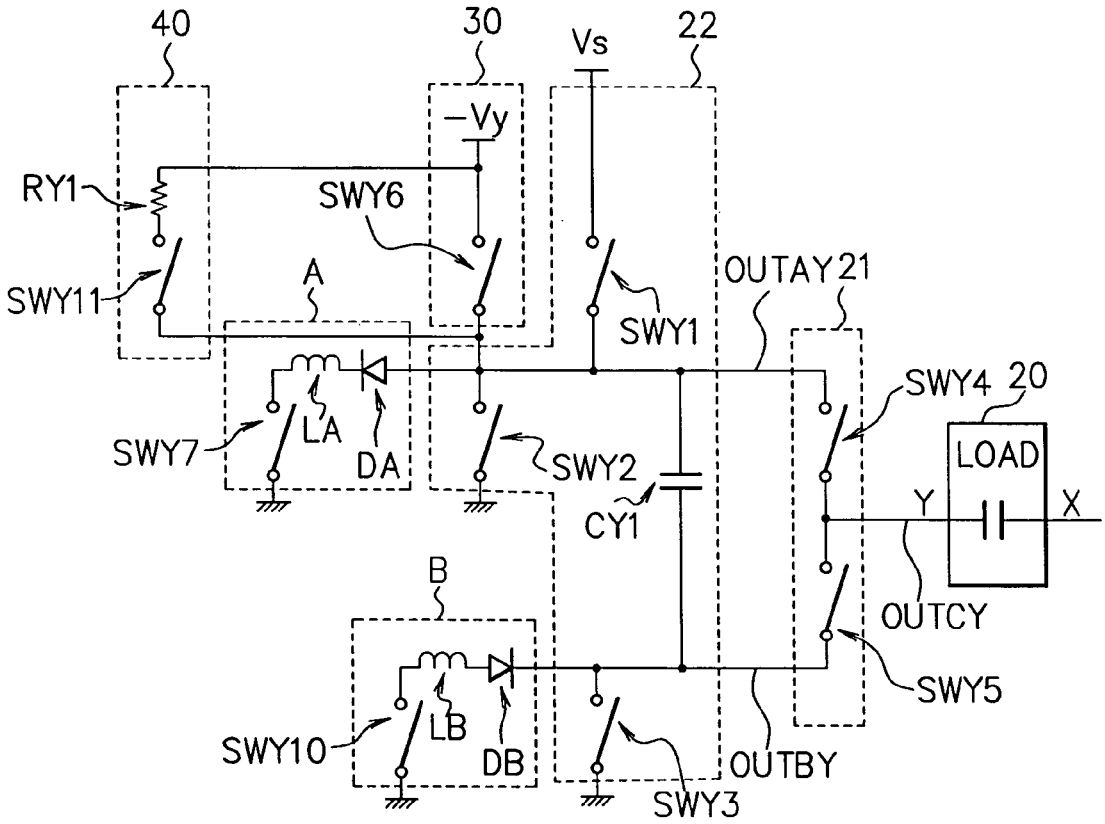
FIG. 10 is a view showing yet another configuration example of the drive circuit according to the second embodiment.

FIG. 9 and FIG. 10 are views showing still another examples of the drive circuit according to the second embodiment. In these FIG. 9 and FIG. 10, the same symbols and numerals are attached to components having the same functions as the components shown in FIG. 5, so that overlapping explanation thereof will be restrained.

In FIG. 9, the coil circuit A includes a diode DA, a coil LA and a switch SWY7. An anode terminal of the diode DA is connecting an interconnection point (a first signal line OUTAY) of switches SWY1 and SWY2, and a cathode terminal is connected to the ground via the coil LA and the switch SWY7. Further, the coil circuit B includes a diode DB, a coil LB and a switch SWY10. A cathode terminal of the diode DB is connected to an interconnection point (a second signal line OUTBY) of a switch SWY3 and the other terminal of a capacitor CY1, and an anode terminal is connected to the ground via the coil LB and the switch SWY10.

In FIG. 10, a ramp wave generation circuit 40 includes a resistor RY1 and a switch SWY11. The ramp wave generation circuit 40 is a circuit to generate a ramp wave waveform which changes an impressed voltage value according to the time, which can supply a negative potential (−Vy), instead of a negative potential supply circuit 30, to the first signal line OUTAY more slowly than the negative potential supply circuit 30. Further, during a reset period, the potential of generated ramp wave can be reduced to (−Vs−Vy) by turning the SWY11 of the ramp wave generation circuit 40 on.

It is also possible to obtain an effect similar to that of the drive circuit shown in FIG. 5, with the drive circuit according to the second embodiment shown in FIG. 8 to FIG. 10.

Figure 11:
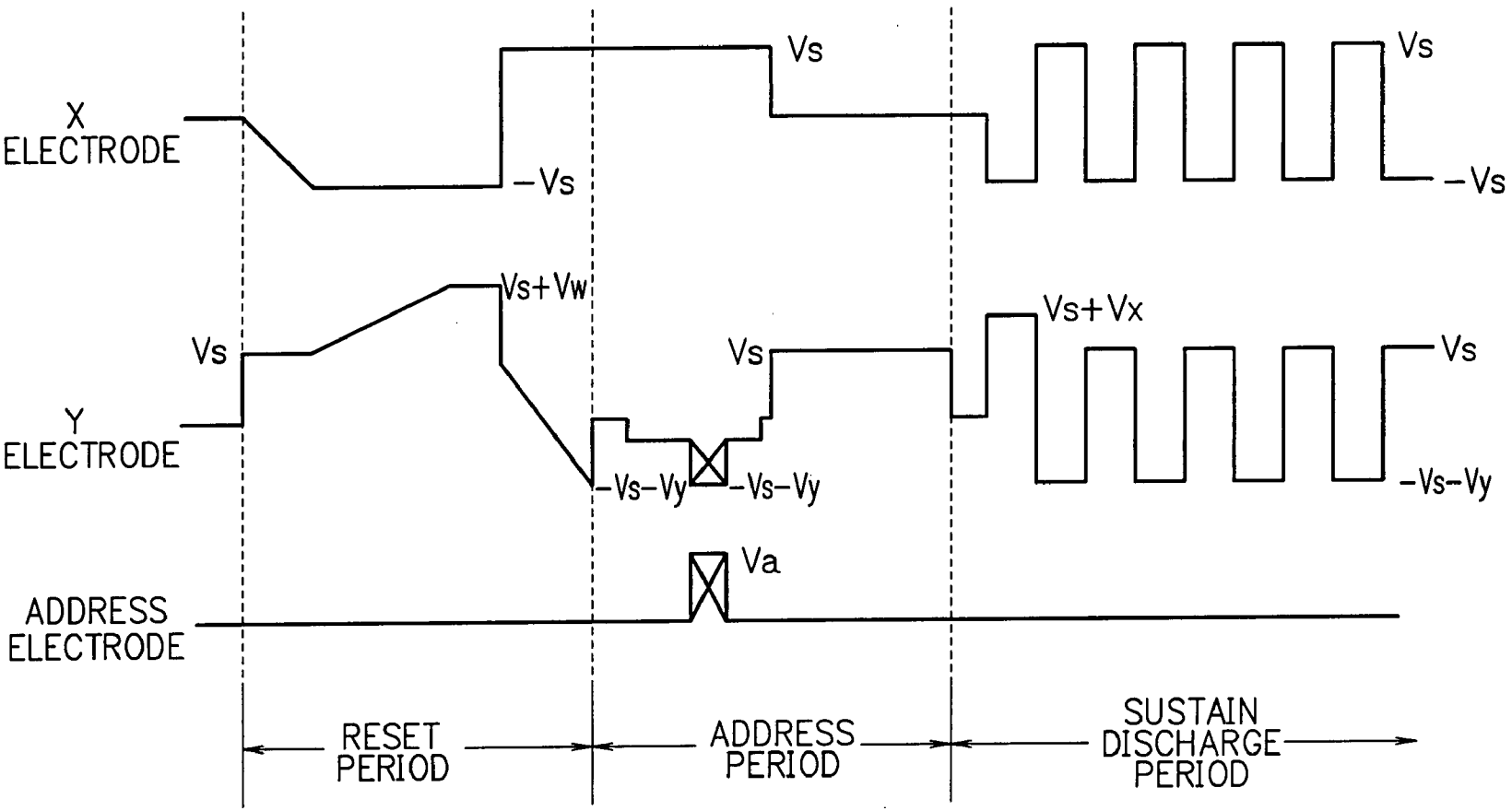
FIG. 11 is a waveform diagram showing the operation of an AC drive type PDP device according to the embodiment of the present invention.

FIG. 11 is a waveform diagram showing the operation of an AC drive type PDP device 1 in the embodiments of the present invention. FIG. 11 shows an example of the waveform of the voltage applied to a common electrode X, a scanning electrode Y and an address electrode in a sub-field portion of a plurality of sub-fields which form one frame. One sub-field is divided into the reset period composing of the entire writing period and the entire erasing period, the address period and the sustain discharge period. Incidentally, the waveform diagram shown in FIG. 11 shows the case of the drive circuit having the negative potential supply circuit 30 and the ramp wave generation circuit 40 described above on the Y side drive circuit.

During the reset period, the voltage applied to the common electrode X is first reduced from the ground potential level, the reference potential, to (−Vs). On the other hand, the voltage applied to the scanning electrode Y is gradually increased with time and a final voltage obtained by combining the writing voltage Vw and the voltage Vs is applied to the scanning electrode Y.

Thus, the potential difference between the common electrode X and the scanning electrode Y becomes (2 Vs+Vw) in spite of being still in a display state as before, discharge is performed in all cells of whole display lines, so that a wall electric charge is formed. (entire writing).

Next, after the voltage of the scanning electrode Y is restored to Vs, the voltage applied to the common electrode X is gradually increased from (−Vs) to Vs, and at the same time, the impressed voltage to the scanning electrode Y is gradually reduced from the voltage Vs as time passes. On the scanning electrode Y side, a final voltage (−Vs−Vy) is applied to the scanning electrode Y by turning the switch SWY11 of the ramp wave generation circuit 40 on. Thereby, a discharge is started because the voltage of the wall electric charge itself exceeds the discharge start voltage over all cells, so that the stored wall electric charge is erased (entire erasing).

Next, during the address period, in order to perform ON/OFF of respective cells according to display data, the address discharge is performed linear sequentially. At this time, the voltage Vs is applied to the common electrode X. By controlling the respective switches SWY1 to SWY6 on the scanning electrode Y side as shown in FIG. 2 or FIG. 6, a scan pulse at (−Vs−Vy) level is applied to the scanning electrode Y selected linear sequentially, and the voltage (−Vy) is applied to a not-selected scanning electrode Y, when a voltage is applied to a scanning electrode Y corresponding to a certain display line.

At this time, the address pulse at a voltage Va is selectively applied to an address electrode Aj corresponding to a cell causing the sustain discharge, that is a cell to be lit, among respective address electrodes A1 to Am. As a result, discharge is taken place between the address electrode Aj of the cell to be lit and the scanning electrode Y selected linear sequentially, and a certain amount of wall electric charge required for next sustain discharge is stored on an MgO protection film surface over the common electrode X and the scanning electrode Y, using the above discharge as a priming (pilot frame).

It should be noted that though *Fig.*11 shows an example in which the address period is divided into a first half address period (for instance, sequential scan pulses are applied to the scanning electrodes Y in odd numbered lines) and the second half address period (for instance, sequential scan pulses are applied to scanning electrodes Y in even-numbered lines), it is also acceptable to apply the sequential scan pulse to the scanning electrode Y without dividing the address period.

Thereafter, during the sustain discharge period, sustain discharge is performed by applying a predetermined voltage (sustain pulse) in a manner that the phases are in a reverse relation to each other to the common electrode X and the scanning electrodes Y of respective display lines, so that an image of one sub-field is displayed. At this time, as a sustain pulse, voltages (+Vs, −Vs) are alternately applied to the common electrode X. And as shown in FIG. 3, by controlling the respective switches SWY 1 to SWY 6, voltages (+Vs, −Vs−Vy) are alternately applied as a sustain pulse to the scanning electrode Y. Note that the switch control is not limited to that shown in FIG. 3 above, it is acceptable to apply voltages (+Vs, −Vs−Vy) alternately to the scanning electrode Y by controlling the switches as shown in FIG. 4 and FIG. 7 described above.

Note that the voltage (Vs+Vx) is applied only when a high voltage is applied first to the scanning electrode Y during the sustain discharge period. This voltage Vx is that to be added for generating a voltage necessary to the sustain discharge by adding to the voltage of the wall electric charge generated during the address period.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

According to the present invention, by supplying a potential lower than the reference potential to the first signal line from the potential supply circuit, the potential of the second signal line connected to the first signal line via the capacitor is made to be a third potential lower than the second potential so that the third potential is applied to the capacitive load from the second signal line. Accordingly, since no voltage larger than the potential difference between the reference potential and the first and second potential is applied to the respective elements in the drive circuit, a voltage having a potential difference larger than was previously possible in relation to the reference potential can be applied to the capacitive load without increasing withstand voltage of the respective elements.

What is claimed is:

1. A drive circuit of a plasma display device for applying a drive voltage to a plurality of electrodes of a plasma display panel, said drive circuit comprising:

output lines connected to one end of each of the electrodes;

a first signal line for supplying a first potential higher in potential than a reference potential to the one end of each of the electrodes via a respective output line;

a second signal line for supplying a second potential lower in potential than the reference potential to the one end of each of the electrodes via the respective output line;

a capacitor connected between the first signal line and the second signal line;

a first switch connected between a first power supply line for supplying the first potential and the first signal line;

a second switch connected between the second signal line and the reference potential;

a plurality of third switches and a plurality of fourth switches connected in series between the first signal line and the second signal line; and a fifth switch connected between a second power supply line for supplying a third potential lower in potential than the reference potential and the first signal line;

wherein each pair of one of the third switches and one of the fourth switches is respectively connected in series between the first signal line and the second signal line, and each interconnection point of the third switch and the fourth switch is connected to each of the output lines; and in an address period, selecting cells to be lit according to display data, turning off the first and second switches, and turning on the fifth switch, a negative superimposed voltage, which is the second potential being a voltage charged inside the capacitor superimposed on the third potential, is generated to the second signal line, by turning the third switches off and the one fourth switch corresponding to the electrode is scanned among the fourth switches on, applying the negative superimposed voltage as a scan pulse to the electrode is scanned via the one fourth switch and the output line corresponding to the electrode is scanned, in a period of the address period during which the scan pulse is applied, applying the third potential to the electrodes via the first signal line and the output lines, by turning the third switches on and the fourth switches off, in the address period except for the period during which the scan pulse is applied.

2. The drive circuit of a plasma display device according to claim 1 further comprising:

a resistor and a sixth switch connected in series between the second power supply line and the first signal line;

wherein a superimposed voltage waveform, which is the voltage charged inside the capacitor superimposed on the voltage waveform of a negative polarity decreasing an impressed voltage value according to the time is generated to the second signal line, by turning the first, second, third and fifth switches off and the fourth and sixth switches on, applying the superimposed voltage waveform as a negative reset pulse to the electrode via the fourth switch and the output line, in a reset period.

3. The drive circuit of a plasma display device according to claim 2, wherein an attained potential of the voltage waveform of a negative polarity is the third potential.

* * * * *

UNITED STATES PATENT AND TRADEMARK OFFICE

CERTIFICATE OF CORRECTION

PATENT NO. : 7,633,497 B2
APPLICATION NO. : 10/984978
DATED : December 15, 2009
INVENTOR(S) : Tomoya Matsui et al.

It is certified that error appears in the above-identified patent and that said Letters Patent is hereby corrected as shown below:

On the Title Page Item (57) (Abstract), Lines 1-13, change
"An air purifier includes a main body defining an air passage therein to allow sucker air to pass therethrough prior to being discharged, and a first filter installed in the main body to be switched between a closed state and an open state. The first filter removes contaminants from the sucked air in the closed state, and allows the sucked air to pass through the air passage in the open state. The air purifier may include a main body to suck and discharge air, with a bypass passage formed in the main body so that the bypass passage is opened or closed by a door, and a first filter installed in the main body. The sucked air passes through the first filter prior to being discharged when the door is closed, and passes through the bypass passage prior to being discharged when the door is opened." to
--A drive circuit includes: an output line connected to one end of the load; a first signal line for supplying a first potential higher in potential than a reference potential; a second signal line for supplying a second potential lower than the reference potential and a third potential still lower than the second potential; and a potential supply circuit connected to the first signal line for supplying a fourth potential (-Vy) lower than the reference potential to the first signal line, wherein a potential of the second signal line connected to the first signal line via the capacitor is made to be a third potential by supplying the fourth potential lower than the reference potential to the first signal line so that the third potential is supplied to the capacitive load from the second signal line.--.

Column 1, Line 4, change "TO-RELATED" to --TO RELATED--.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,633,497 B2
APPLICATION NO. : 10/984978
DATED : December 15, 2009
INVENTOR(S) : Matsui et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1255 days.

Signed and Sealed this

Ninth Day of November, 2010

David J. Kappos

David J. Kappos
*Director of the United States Patent and Trademark Office*